US006283337B1

(12) United States Patent
Nakamura et al.

(10) Patent No.: US 6,283,337 B1
(45) Date of Patent: Sep. 4, 2001

(54) AEROSOL CONTAINER

(75) Inventors: Yukio Nakamura; Mikio Furukawa, both of Tokyo (JP)

(73) Assignee: Kao Corporation, Tokyo (JP)

( * ) Notice: Subject to any disclaimer, the term of this patent is extended or adjusted under 35 U.S.C. 154(b) by 0 days.

(21) Appl. No.: 09/460,439

(22) Filed: Dec. 14, 1999

(30) Foreign Application Priority Data

| | | |
|---|---|---|
| Dec. 21, 1998 | (JP) | 10-363128 |
| May 20, 1999 | (JP) | 11-140094 |
| Jul. 8, 1999 | (JP) | 11-194248 |

(51) Int. Cl.[7] ..... B65D 83/14
(52) U.S. Cl. ..... 222/402.13; 222/402.1
(58) Field of Search ..... 222/402.1, 402.11, 222/402.12, 402.13

(56) References Cited

U.S. PATENT DOCUMENTS

| | | | | |
|---|---|---|---|---|
| 3,343,201 | * | 9/1967 | Cox et al. | 222/402.11 |
| 3,383,879 | * | 5/1968 | Tice | 222/402.12 |
| 3,678,578 | * | 7/1972 | Patton, Jr. et al. | 30/448 |
| 3,744,681 | * | 7/1973 | Morane | 222/402.12 |
| 3,756,472 | * | 9/1973 | Vos | 222/402.14 |
| 3,770,170 | * | 11/1973 | Hayes | 222/402.11 |
| 3,776,226 | * | 12/1973 | Triplett | 222/402.1 |
| 4,024,988 | | 5/1977 | Starrett . | |
| 4,077,546 | * | 3/1978 | Winkelried | 222/179 |
| 4,331,137 | * | 5/1982 | Sarui | 128/200.16 |
| 4,410,110 | * | 10/1983 | Del Bon et al. | 222/402.1 |
| 5,186,364 | * | 2/1993 | Laszlo | 222/402.11 |

FOREIGN PATENT DOCUMENTS

| | | |
|---|---|---|
| 0 530 121 | 3/1993 | (EP) . |
| 2115650 | 7/1972 | (FR) . |
| 2157569 | 6/1973 | (FR) . |
| 1 359 152 | 7/1974 | (GB) . |
| 2 181 489 | 4/1987 | (GB) . |
| 55-2428 | 1/1980 | (JP) . |

* cited by examiner

*Primary Examiner*—J. Casimer Jacyna
(74) *Attorney, Agent, or Firm*—Oblon, Spivak, McClelland, Maier & Neustadt, P.C.

(57) ABSTRACT

An aerosol container 10 having a perforated nozzle member 11 disposed at a distal end of a container body 12 with a content stored therein and for discharging the content onto the sole of a foot by stepping on the perforated nozzle member 11, wherein projections are provided at a location surrounding a plurality of nozzle ports 14 formed in the perforated discharge nozzle member 11 and an interval between a sole side of the foot and the nozzle ports 14 is retained by the projection when the perforated discharge nozzle member 11 is stepped on. The projections surrounding the plurality of nozzle ports 14 are an annular wall 32 and an upper end of the annular wall 32 is defined as an opening having a size dimension able to be covered with the sole of a foot.

5 Claims, 6 Drawing Sheets

AEROSOL CONTAINER

BACKGROUND OF THE INVENTION

1. Field of the Invention

This invention relates to an aerosol container having a discharge nozzle member disposed on a distal end of a container body with a content stored therein and for discharging the content onto the sole of a foot by stepping on the discharge nozzle member.

2. Description of the Related Art

When a chemical, such as an insecticide, a refrigerant or the like, is applied to the sole of a foot or between adjacent toes using an aerosol container, the user usually holds the aerosol container with the hand and applies the content directly to the sole, etc. or collects a proper quantity of the content by a hand and then applies it to the sole, etc., while maintaining the attitude of bending the knee or sitting in a chair or sitting on the floor.

Also, the conventional aerosol container generates an offensive sound to the ear when the content liquid is applied, and produces high injection sound by which the use is easy to be recognized.

Moreover, the aerosol container has a stem disposed at a distal end portion of the container body which stores therein an application liquid (content liquid) air-tight. The application liquid is discharged from the nozzle member by depressing the nozzle member mounted on this stem against a resilient force. In order to prevent the application liquid from being accidentally discharged by inadvertently depressing the nozzle portion when the aerosol container is not in use, a device is disclosed, for example, in Japanese Utility Model Unexamined Publication (Kokai) No. Sho 55-82428, in which the nozzle member is turned to be locked so that the nozzle member cannot be depressed when not in use. According to this locking mechanism, when the aerosol container is in use, the application liquid can be discharged by turning the nozzle member towards a releasing side and then depressing the same. However, the nozzle member is not automatically resorted to its locked position even if depression against the nozzle member is released. Instead, it is necessary to return the nozzle member to its locked position by turning the nozzle member with a hand or the like. Since the user is likely to forget to perform such a locking operation, there is a possibility that the application liquid is inadvertently discharged by incorrect handling of the device.

SUMMARY OF THE INVENTION

It is, therefore, an object of the present invention to provide an aerosol container and a method of using the same, capable of easily applying a content such as a chemical to the sole or between the adjacent toes of the foot without a need of the abovementioned troublesome operation.

It is also another object of the present invention to provide an aerosol container, in which an injection sound generated when the content liquid is applied can easily be reduced to the extent that it is hardly offensive to the ear and that the use cannot be recognized.

A further object of the present invention is to provide an aerosol container capable of easily preventing accidental discharge by automatically restoring a nozzle member into a locked position when the depression against the nozzle member is released.

A still further object of the present invention is to provide an aerosol container including a discharge nozzle member in which a nozzle upper member and a nozzle lower member are formed into a unitary member and a reliable sealability is retained.

The present invention has achieved the above objects by providing an aerosol container having a discharge nozzle member disposed on a distal end of a container body with a content stored therein and for discharging the content onto a sole of a foot by stepping on the discharge nozzle member, wherein projections are provided at a location surrounding nozzle ports formed in the discharge nozzle member and an interval between the sole side of a foot and the nozzle ports is retained by the projections when the discharge nozzle member is stepped on.

It is preferred that the discharge nozzle member is a perforated discharge nozzle member provided with a plurality of nozzle ports, and that the projections surround the plurality of nozzle ports.

The present invention has achieved the above objects by providing an aerosol container, wherein the discharge nozzle member is provided with sound-reduction means.

It is preferred that the sound-reduction means is structured by an annular wall arranged as the projections surrounding the nozzle ports, and an upper end of the annular wall is defined as an opening having a size dimension capable of covering the sole of a foot.

Also, the present invention has achieved the above objects by providing an aerosol container, wherein a skirt member is mounted on a peripheral surface of the container body in such a manner as to surround a stem of the container body to which the discharge nozzle member is attached such that, when the discharge nozzle member is rotated with respect to the skirt member, the perforated discharge nozzle member is brought into a depressible position and when the depression is released, the perforated discharge nozzle member is brought into an undepressible position.

Also, the present invention has achieved the above objects by providing an aerosol container, wherein the discharge nozzle member comprises a nozzle lower part fixedly engaged in an engagement recess, which is formed in a lower surface of a nozzle upper part, in a hermetically closed condition through an O-ring, and wherein a seal construction for hermetically closing the nozzle upper part and the nozzle lower part comprises a recess annular inclination surface formed by an outwardly or inwardly tapered abutment surface of the O-ring disposed in the engagement recess and a lower part annular inclination surface formed by an inwardly or outwardly tapered abutment surface of the O-ring and disposed in opposite relation to the recess annular inclination surface, the O-ring being inserted and sandwiched between the recess annular inclination surface and the lower part annular inclination surface in its compressed condition.

Also, the present invention has achieved the above objects by providing a method of using an aerosol container comprising the step of stepping on a discharge nozzle member disposed at a distal end of an aerosol container with a content stored therein, to thereby discharge the content onto a sole of a foot so that the foot can be treated with the content.

According to the aerosol container and the method of using an aerosol container of the present invention, the content is directly discharged to the sole of a foot by the depressing force caused by the stepping operation. Accordingly, the content such as a chemical or the like can easily be applied to the sole of a foot or between the adjacent toes without a need of maintaining the attitude of bending the knee or sitting.

If the discharge nozzle member of the aerosol container of the present invention is provided with the sound-reduction means, an injection sound generated when the content liquid is applied can easily be reduced to the extent that it is hardly offensive to the ear and hat the use cannot be recognized.

Also, if a skirt member is mounted on a peripheral surface of the container body in such a manner as to surround a stem of the container body to which the discharge nozzle member is attached such that, when the discharge nozzle member is rotated with respect to the skirt member, the discharge nozzle member is brought into a depressible position and when the depression is released, the discharge nozzle member is brought into an undepressible position, accidental discharge can easily be prevented by automatically restoring a nozzle member into a locked position when the depression against the nozzle member is released.

Also, if the discharge nozzle member comprises a nozzle lower part fixedly engaged in an engagement recess, which is formed in a lower surface of a nozzle upper part, in a hermetically closed condition through an O-ring, and wherein a seal construction for hermetically closing the nozzle upper part and the nozzle lower part comprises a recess annular inclination surface formed by an outwardly or inwardly tapered abutment surface of the O-ring disposed in the engagement recess and a lower part annular inclination surface formed by an inwardly or outwardly tapered abutment surface of the O-ring and disposed in opposite relation to the recess annular inclination surface, the O-ring being inserted and sandwiched between the recess annular inclination surface and the lower part annular inclination surface in its compressed condition, the aerosol container of the present invention can be provided with a discharge nozzle member in which a nozzle upper member and a nozzle lower member are formed into a unitary member and a reliable sealability is retained.

BRIEF DESCRIPTION OF THE DRAWINGS

FIG. 4(*b*) is a bottom view when FIG. 4(*a*) is viewed in a direction as indicated by an arrow A.

FIG. 5(*b*) is a sectional view taken along B—B of FIG. 5(*a*);

DETAILED DESCRIPTION OF THE INVENTION

Figure 1:
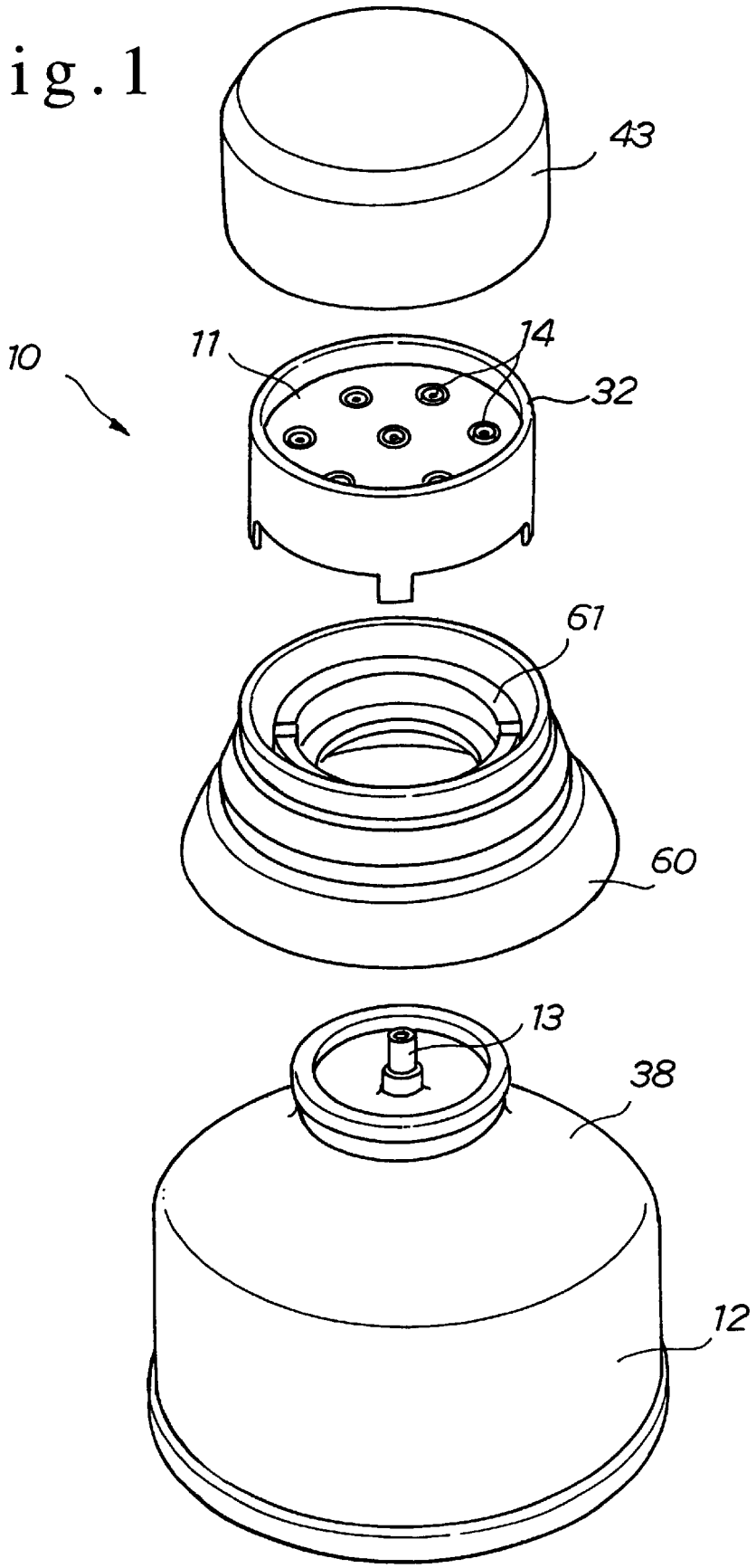
FIG. 1 is a schematically illustrated exploded perspective view showing an aerosol container according to one embodiment of the present invention.

The present invention will now be described in the form of its one preferred embodiment. An aerosol container 10, shown in FIGS. 1 and 2, according to this embodiment is a step-on type discharge container which is placed, for example, under a desk of one's job site and which ejects an application liquid such as a refrigerant, an insecticide, an aromatic or the like so as to be applied to the sole side of a foot through nozzle ports 14 which are opened in an upper surface of a perforated discharge nozzle member 11 when the perforated discharge nozzle member 11 is stepped on to depress it. This aerosol container 10 comprises a container body 12 and the perforated discharge nozzle member 11 projecting upwardly of the container body 12.

The container body 12, in which an application liquid (content liquid) is stored air-tight, has a stem 13 which is caused to project upwardly from a distal end portion of the container body 12 under the effect of resiliency of a spring disposed within a valve mounted in the container body 12. The perforated discharge nozzle member 11, which has a disc-like configuration, is attached to the container body 12 in such a manner as to cover a tip of the stem 13. By depressing this perforated discharge nozzle member 11 downward in an axial direction of the stem 13, the application liquid is discharged upward from the nozzle ports 14, which are in communication with the interior of the container body 12 through the stem 13, so as to be applied to the sole side of the foot.

The container body 12 is made of synthetic resin, metal or the like and is a hollow container having a circular configuration in section, with a diameter of about 9 cm at its bottom surface and a height of about 8 cm. Owing to this feature, it has a low gravity. Therefore, it can be placed on the floor in such a stable fashion that it is not fallen even when the perforated discharge nozzle member 11 of the aerosol container 10 is depressed by the foot.

The perforated discharge nozzle member 11 is made of synthetic resin and has a disc-like configuration. The perforated discharge nozzle member 11 has a circular column-like stem engagement projection 15 projecting downward from a central portion of a lower surface thereof. By bringing an upper end portion of the stem 13 into engagement in an engagement hole 16 formed in the stem engagement projection 15, the stem 13 can communicate with a liquid passage 20 formed within the perforated discharge nozzle member 11 via a through-hole 81 which is formed in a central area of the stem engagement projection 15. The liquid passage 20 comprises a lateral passage 20a extending in a radial direction from the center of the perforated nozzle member 11 and seven vertical flow passages 20*b* extending all the way through the nozzle upper part 12, one being formed in the center of the nozzle upper part 12 and the remaining six in the peripheral edge portion. These seven vertical flow passages 20*b* are connected respectively to corresponding nozzle ports 14 one of which is formed in the center of a surface of the discharge nozzle member 11 and the remaining six in the peripheral edge portion.

Figure 2:
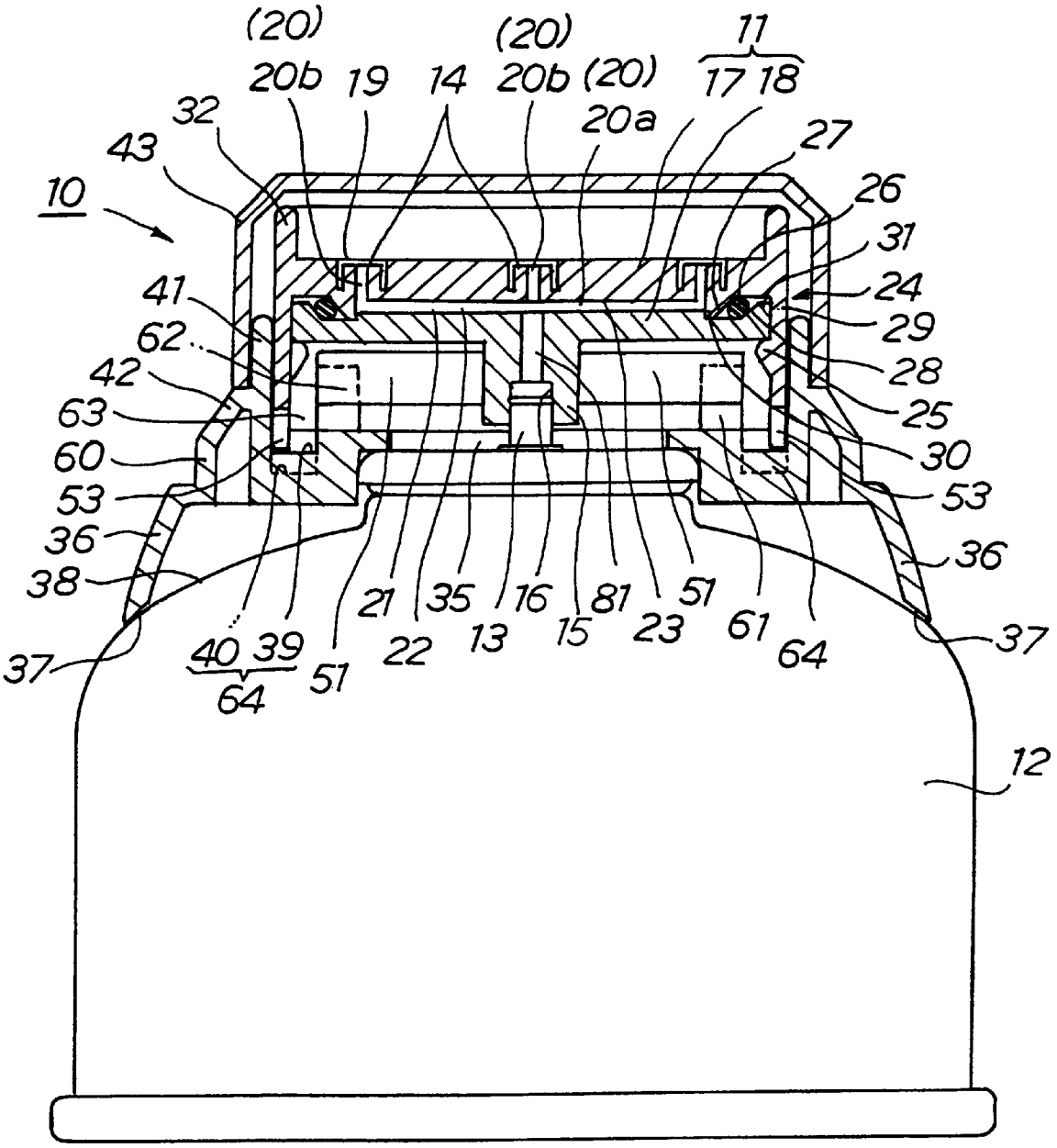
FIG. 2 is a sectional view showing an essential portion for explaining a construction of an aerosol container according to one embodiment of the present invention.
Figure 3:
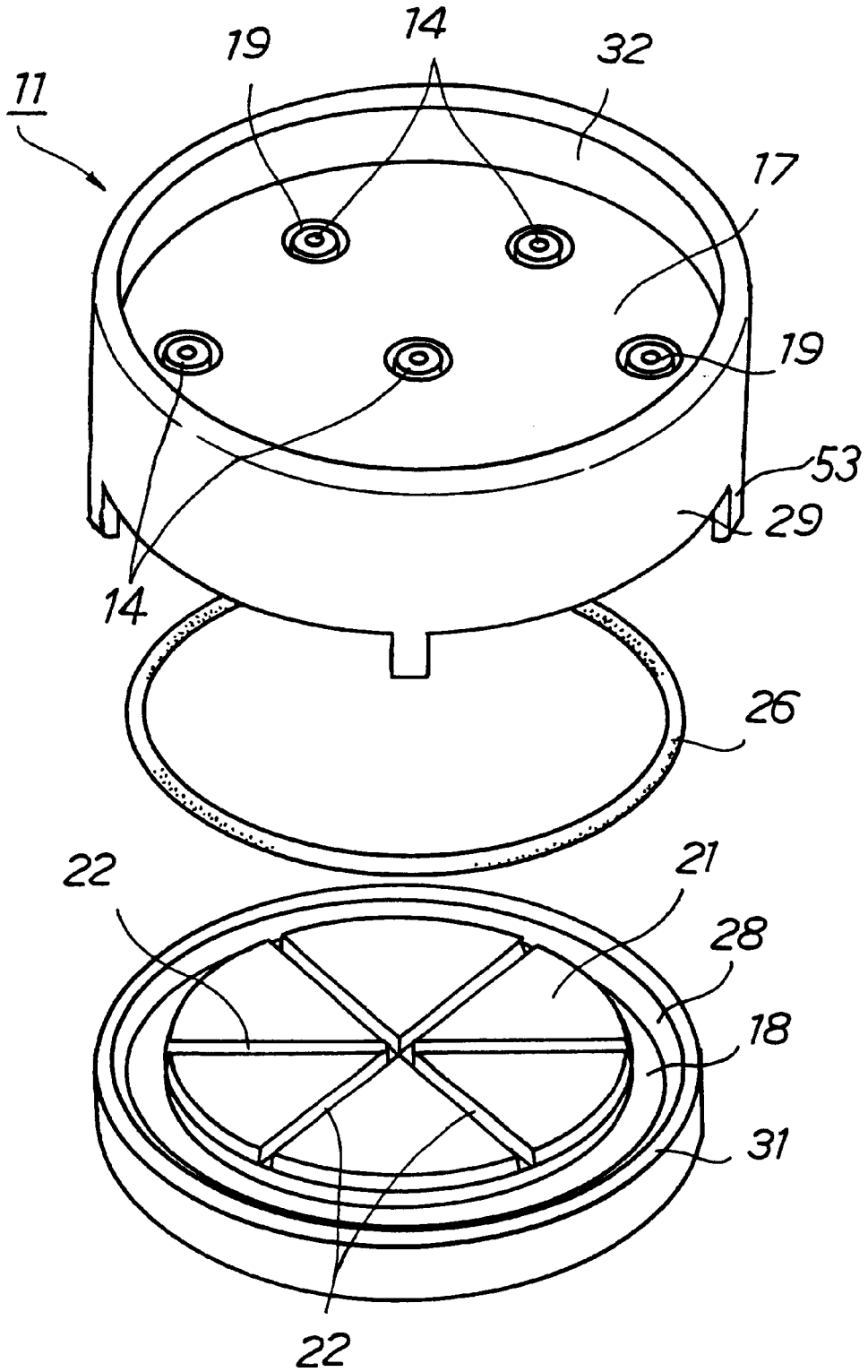
FIG. 3 is an exploded perspective view for explaining a construction of a perforated discharge nozzle member of the aerosol container.

In order to form the radially extending lateral flow passage 20*a* within the perforated discharge nozzle member 11, the perforated discharge nozzle member 11 comprises the nozzle upper part 17 and the nozzle lower part 18 which are formed into a unitary member through an O-ring 26 as shown in FIG. 3. That is, a flattened central round protrusion 21, which is formed on an upper surface of the nozzle lower part 18, has three linear grooves extending in a diametrical direction thereof. Those three linear grooves cross one another at the center of the flattened central round protrusion 21, thereby forming radial grooves 22 extending in six radial directions. Accordingly, when the nozzle lower part 18 is fixedly engaged in an engagement recess 23 which is formed in a lower surface of the nozzle upper part 17, with an upper surface of the central round protrusion 21 intimately contacted with a lower surface of the nozzle upper part 17, the lateral flow passage 20*a* is defined by the radial grooves 22 and the lower surface of the nozzle upper part 17. Also, as shown in FIG. 2, distal ends of the six radial grooves 22 are communicated respectively with the corresponding vertical flow passages 20*b* which are formed in the peripheral edge portions of the nozzle upper part 17.

In this embodiment, a seal construction 24 is employed, in which the nozzle lower part 18 is fixedly engaged in the engagement recess 23, which is formed in the lower surface of the nozzle upper part 17, in a hermetically closed condition through the O-ring 26, so that the application liquid can smoothly be supplied into the respective nozzle ports 14 through the lateral flow passage 20*a*.

The seal construction 24 comprises, as shown in FIG. 2, a recess annular inclination surface 27 formed by an outwardly tapered abutment surface of the O-ring 26 disposed in the engagement recess 23 of the nozzle upper part 17 and a lower part annular inclination surface 28 formed by an inwardly tapered abutment surface of the O-ring 26 in the nozzle lower part 18 and disposed in opposite relation to the recess annular inclination surface 27, the O-ring 26 being inserted and sandwiched between the recess annular inclination surface 27 and the lower part annular inclination surface 28 in its compressed condition.

The O-ring 26 is made from elastic material such as, for example, silicon and NBR (nitrile-butadiene rubber). The O-ring 26 is a ring-like member having a circular configuration in section and having a dimension so as to be disposed along the recess annular inclination surface 27 or the lower part annular inclination surface 28.

The recess annular inclination surface 27 is served as an outer inclination surface of a lower surface annular projection 30 which is disposed spacedly from and along an inner side of a skirt wall 29 which defines the engagement recess 23 in the lower surface of the nozzle upper part 17. The recess annular inclination surface 27 is inclined at an angle of 45 degrees with respect to the lower surface of the nozzle upper part 17. The lower surface annular projection 30 has a circular recess formed in its inner side. The central round protrusion 21 of the nozzle lower part 18 is disposed at the circular recess in intimately contacted relation.

On the upper surface of the nozzle lower part 18, the lower part annular inclination surface 28 is inclined as an inner inclination surface of an upper surface annular projection 31 disposed spacedly from the central round protrusion 21 and along a peripheral edge portion of the nozzle lower part 18, at an angle of 45 degrees with respect to the upper surface of the nozzle lower part 18.

The seal construction 24 is provided when the perforated discharge nozzle member 11 is formed into a unitary member by engaging the nozzle lower part 18 in the engagement recess 23 of the nozzle upper part 17 through the O-ring 26.

Arranged in a peripheral direction on an inner wall surface of the skirt wall 29 of the nozzle lower part 18, there are, for example, four engagement projections 25 at a predetermined interval (interval large enough to engage the nozzle lower part 18 in the engagement recess 23 with the central round protrusion 21 held in intimately contacted relation with the circular recess of the nozzle upper part 17) from the lower surface of the nozzle upper part 17. Therefore, when the nozzle lower part 18 is brought into engagement in the engagement recess 23 such that the lower surface peripheral edge portion thereof is engaged with the engagement projections 25 with the O-ring 26 interposed between the recess annular inclination surface 27 and the lower part annular inclination surface 28, there can be obtained the perforated discharge nozzle member 11 in which the nozzle lower part 18 is fixedly attached to the nozzle upper part 17 to form a rigid unitary member.

The diameter of a circular section of the O-ring 26 is larger than the interval between the recess annular inclination surface 27 and the lower part annular inclination surface 28 disposed in opposite direction to each other. In the state in which the nozzle lower part 18 is fixedly attached to the nozzle upper part 17, the O-ring 26 is inserted and sandwiched therebetween in its compressed condition. Therefore, they are firmly intimately contacted with each other to provide an effective sealability.

According to this seal construction 24, the O-ring 26 is sandwiched between such two inclination surfaces the recess annular inclination surface 27 and the lower part annular inclination surface 28 and a compressive force is incurred not only in a vertical direction which is coincident with the attaching direction but also in a lateral direction. Therefore, even when the engagement by the engagement projections 25 loosens in the attaching direction of the nozzle lower part 18 and play occurs thereby failing to incur a sufficient amount of compressive force in the vertical direction, a firm sealability can be retained because the lateral compressive force is sustained by the support by the skirt wall 29 surrounding the nozzle lower part 18.

That is, according to this embodiment, by virtue of a provision of the seal construction 24, sealability can positively be retained when the nozzle lower part 18 is fixedly attached to the engagement recess 23 through the O-ring 26. Therefore, according to the aerosol container 10 of this embodiment, there can be provided a perforated discharge nozzle member 11 in which sealability is positively retained and the nozzle upper part 17 and the nozzle lower part 18 are formed into a unitary member.

Also, according to this embodiment, the perforated discharge nozzle member 11 has a disc-like configuration whose upper surface is about 5 cm in diameter and about 1.5 cm in height. Seven, in total of nozzle ports 14 each having an aperture of 0.3 mm are opened, as injection ports, at the upper surface of the perforated discharge nozzle 11, one at a central area and six along the circumferential direction as shown in FIG. 3. Owing to the arrangement in which seven nozzle ports 14 are arranged in a generally equally scattered pattern on the upper surface of the perforated discharge nozzle member 11, the application liquid, as the content liquid, can be generally uniformly sprayed (ejected) over an entire area of the upper surface of the perforated discharge nozzle member 11.

The perforated discharge nozzle member 11 has the annular wall 32, as a ring-like protrusion, protruded from the upper surface peripheral edge portion in such a manner as to surround the seven injection ports 13 as one group.

The perforated discharge nozzle member 11 of the aerosol container 10 placed under a desk is depressed by being stepped thereon by that area of a foot to which the content liquid is to be applied, in such a manner as to cover the annular wall 32 from above, thereby ejecting the content liquid from the nozzle ports 14 so as to be applied to the sole side of the foot. Since the annular wall 32 is disposed along the upper surface peripheral edge portion of the perforated discharge nozzle member 11 at a diameter of about 4 cm and its installation area is dimensioned such as to be covered with the sole side of the foot, the inner side of the annular wall 32 is hermetically closed during the abovementioned depressing operation so that injection sound is difficult to escape through the nozzle ports 14. Thus, a sound reduction effect can be exhibited. The interval between the sole side of the foot and the nozzle ports 14, namely, spraying distance, can be obtained by the height of the annular wall 32 as a projection for surrounding the nozzle ports 14 as a group.

The sound pressure levels were measured for comparison during the spraying operation of the content of the aerosol container with respect to the aerosol container 10 of this embodiment in which the annular wall 32 is provided as a sound reduction wall and an aerosol container from which the sound reduction wall has been removed, under the same pressure level of the spraying agent. As a result, the sound level was found to be 68 dB (the sound level inside a train) for the aerosol container having no sound reduction wall, whereas the sound level was found to be 57*d* (the sound level of a normal conversation at a distance of 1 m) for the aerosol container 10 having the sound reduction wall. In this way, the sound reduction effect was apparently recognized. This measurement was carried out at a location 0.1 m away from the nozzle portion and under the environment of a peripheral sound of 50 dB, using a sound-level meter (merchandise name: NA-09 manufactured by Rion Co. Ltd.).

Figure 4A:
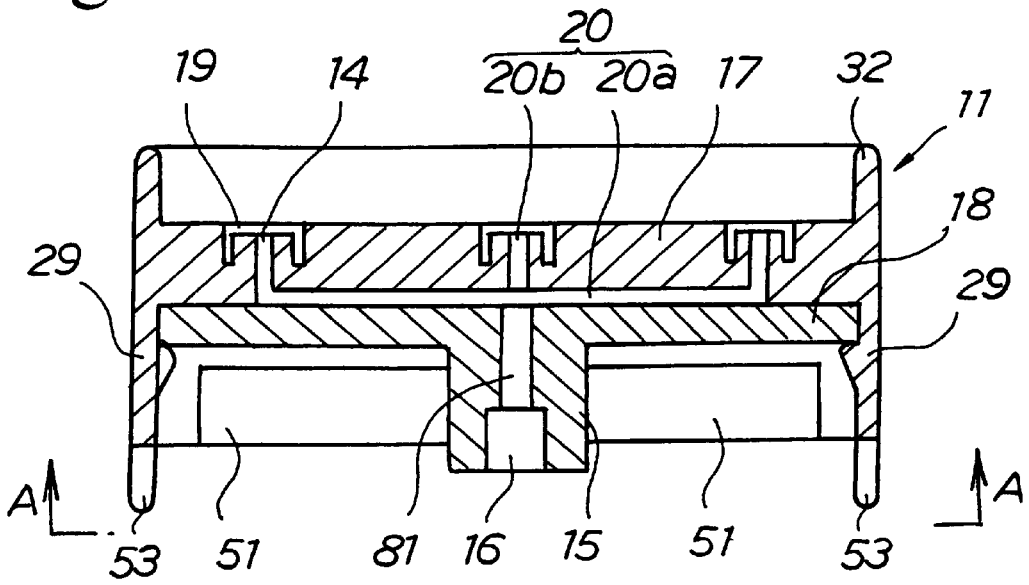
FIG. 4(*a*) is a sectional view for explaining a construction of the perforated discharge nozzle member.
Figure 4B:
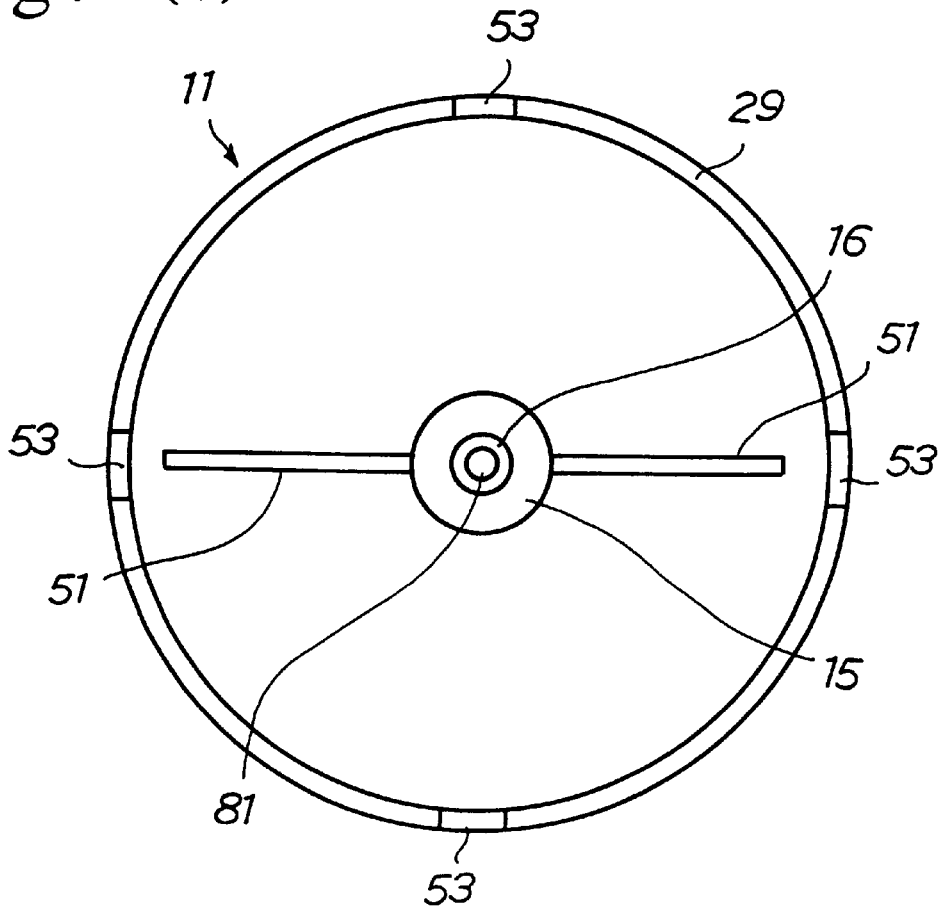

According to this embodiment, as shown in FIGS. 4(*a*) and 4(*b*), a pair of synthetic resin leaf springs 51 serving as rotation reinforcing means are attached to the perforated discharge nozzle member 11 with one ends thereof joined to an outer peripheral area of the stem engagement projection 15, the pair of leaf springs 51 being allowed to extend in the opposite directions. The other ends of the leaf springs 51 are held in corresponding cuts 62 formed in a circular wall 61 of a skirt member 60 in a sandwiched manner therebetween as later described.

Furthermore, according to this embodiment, the perforated discharge nozzle member 11 has four downwardly projecting stopper projections (protections) 53 each having a width of about 3 mm. Those stopper projections 53 are formed on a lower end face of the annular skirt wall 29 which are disposed along a lower surface peripheral edge portion of the perforated discharge nozzle member 11, at locations dividing the end face into four sections in a peripheral direction. Those four stopper projections 53 are inserted into corresponding number of two-stage cut-out grooves 63, respectively, of the skirt member 60 as later described.

According to the aerosol container 10 of this embodiment, the skirt member 60 for concentrically providing the circular wall 61 and a circular groove 63 located outwardly of the circular wall 61 with the stem 13 is engaged with and attached to the peripheral surface of the container body 12 in such a manner as to cover the upper end outer peripheral surface of the container body 12 surrounding the stem 13.

Figure 5A:
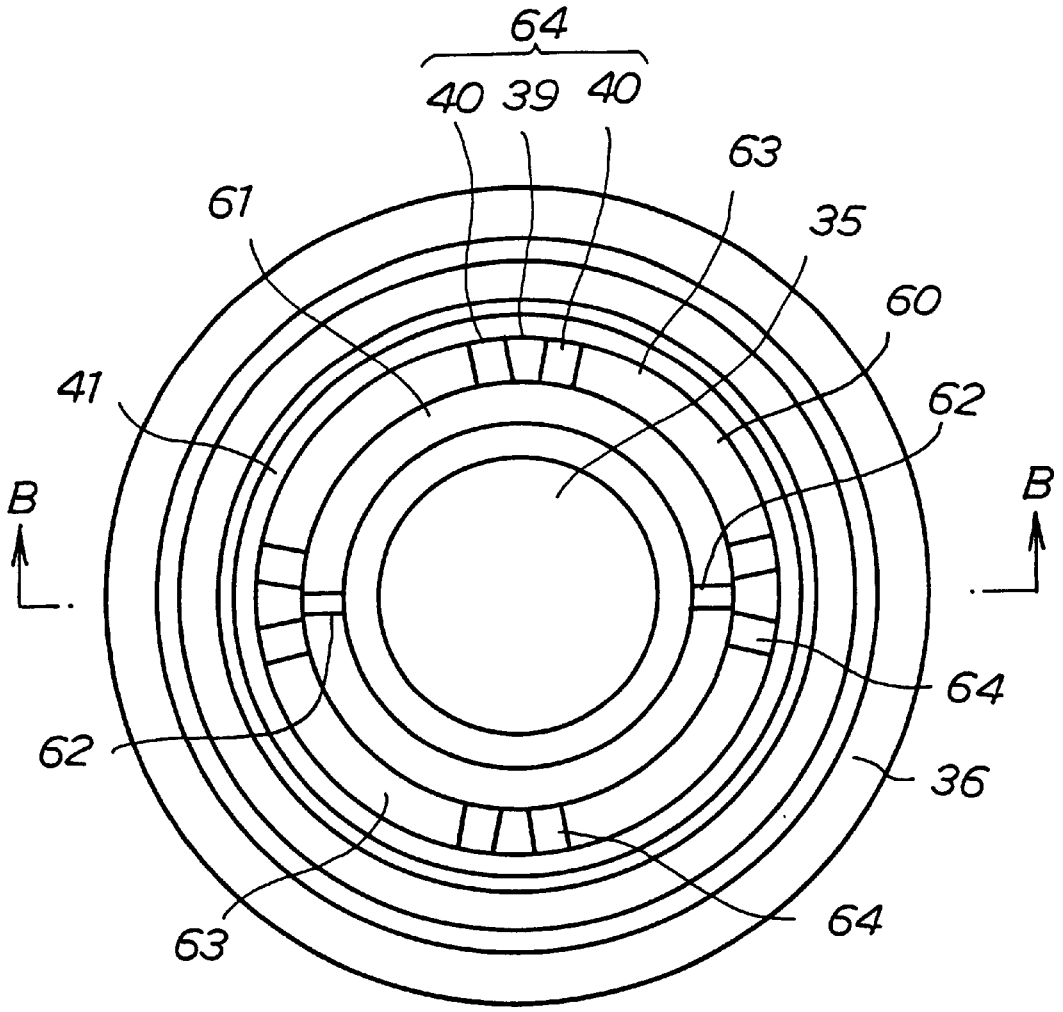
FIG. 5(*a*) is a plan view for explaining a construction of a skirt member.
Figure 5B:
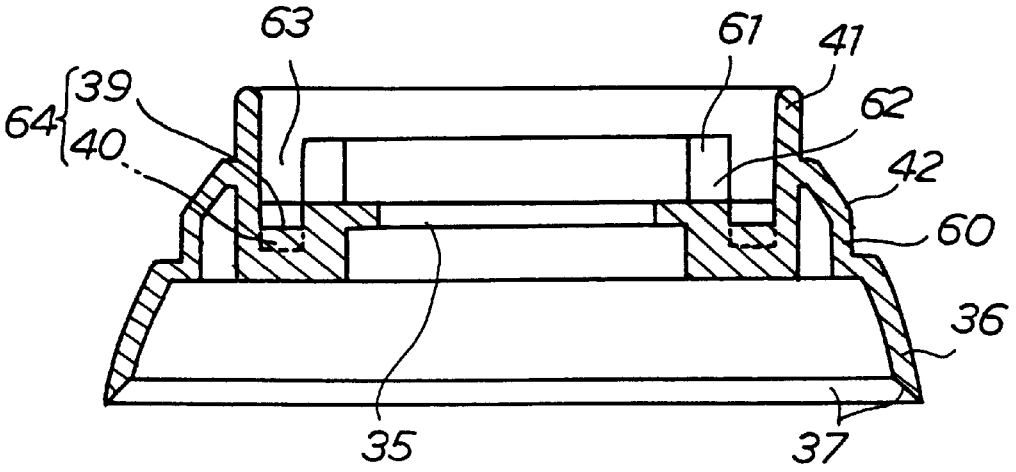

As shown in FIGS. 2, 5(*a*) and 5(*b*), the skirt member 60 is an annular member having at its central area an opening 35 for allowing the stem 13 to be inserted therein. The skirt member 60 exhibits a circular configuration in a plan view and a trapezoidal configuration having equal side length dimensions in section. A lower end face 37, which is indented slantwise inwardly, of a downwardly spreading lower half skirt portion 36 is placed on a shoulder portion 38, which is curved slantwise, of the upper end peripheral surface of the container body 12. By doing so, the skirt member 60 is attached in such a manner as to be concentric with the stem 13, while disposing the stem 13 at the center of the insertion opening 35.

An upper half portion of the skirt member 60 includes the circular wall 61 upstanding along the outer side of the insertion opening 35 and an upstanding outer peripheral wall 41 disposed outwardly and spacedly of the circular wall 61, thereby defining the circular groove 63. The circular groove 61 is formed with a pair of cuts (or indents) 62 at opposing locations in a radial direction thereof When the perforated discharge nozzle member 11 is attached to the stem 13, the other end portions of the leaf springs 51 are inserted into the corresponding cuts 62 in a sandwiched manner and held therebetween. The circular groove 63 is provided with four two-stage cut-out grooves 64 at locations dividing it into four sections in its peripheral direction. Those grooves 64 act as rotation restricting portions, respectively. When the perforated discharge nozzle member 11 is attached to the stem 13, the stopper projections 53 are inserted into the corresponding two-stage cut-out grooves 64.

Each two-stage groove 64 is dimensioned such that it has a length of about 10 mm which is longer than the width of the stopper projection 53. Owing to this feature, the stopper projection 53 can slidingly move in the peripheral direction within the two-stage cut-outs groove 64 and the perforated discharge nozzle member 11 can rotate in the peripheral direction by serving this slidingly movable range as a predetermined range of an angle of play. The side surface of the stopper projection 53 comes into contact with the inside surface of two-stage cut-out groove 64, as a rotation preventive wall, to thereby limit the sliding movement of the side surface of the stopper projection 53 in the peripheral direction, whereby the rotatable play angle range of the perforated discharge nozzle member 11 is limited.

The two-stage cut-out groove 64 is of a two-stage structure in which the groove is divided into an upper stage portion 39 having a reduced depth and occupying about a ⅓ area of the center in the peripheral direction and a lower stage portion 40 disposed at opposite sides of the upper stage portion 39. Where the stopper projection 53 is located above the upper stage portion 39, if the perforated discharge nozzle member 11 is tried to be pushed down, the distal end face of each stopper projection 53 immediately comes into contact with the upper stage portion 39, so that the perforated discharge nozzle member 11 cannot be depressed to the extent that the application liquid is discharged, making the discharge impossible. On the other hand, where the stopper projection 53 is located above the lower stage portion 40, the perforated discharge nozzle member 11 can smoothly be depressed until the distal end face of the stopper projection 53 comes into contact with a bottom surface of the lower stage portion 40. Thus, the application liquid can easily be discharged. That is, the upper stage portion 39 in the two-stage cut-out groove 64, which acts as the rotation restricting portion, constitutes a depression restricting portion for restricting the depression of the perforated discharge nozzle member 11 by coming contact with the distal end of the stopper projection 53. On the other hand, the lower stage portion 40 constitutes a depression releasing portion.

The stopper projections 53 and the leaf springs 51 are disposed on the perforated discharge nozzle member 11 in such positional relationship that when the other ends of the leaf springs 51 are held in the cuts 62 in a sandwiched manner, respectively, the stopper projections 53 are located above the upper stage portion 39 of the two-stage cut-out groove 64. Accordingly, in order to locate the respective stopper projections 53 above the lower stage portion 40, it is necessary to rotate the perforated discharge nozzle member 11 against the reinforcement of the leaf springs 51.

At the outside of the outer peripheral wall 41 of the skirt member 60, there is provided a pedestal 42 adapted to attach a cap 43 thereto. The cap 43 is detachably attached to the pedestal 42 in such a manner as to cover the perforated discharge nozzle member 11 with a lower end face of the cap 43 abutted with the pedestal 42 while fitting the cap 43 onto the outer peripheral wall 41 (see FIGS. 1 and 2).

According to the aerosol container 10 of this embodiment, the skirt member 60 is provided in such a manner as to cover the upper end outer peripheral surface of the container body 12 and then, the perforated discharge nozzle member 11 is attached in such a manner as to cover the distal end of the stem 13 while bringing the upper end portion of the stem 13 into engagement in the engagement hole 16 of the stem engagement projection 15. By doing so, the container body 12, the skirt member 60 and the perforated discharge nozzle member 11 are formed into a unitary member. In that state, the other ends of the respective leaf springs 51 are inserted in the corresponding cuts 62 and held in a sandwiched manner, and the respective stopper projections 53 are located above the upper stage portion 39 of the two-stage cut-out groove 64. Accordingly, the perforated discharge nozzle member 11 is not fully depressed, even if it is tried to be pushed down,, and the application liquid is not discharged from the nozzle ports 14.

In order to apply the application liquid to the sole side of the foot so as to treat the foot by using the aerosol container 10 of this embodiment, the foot is placed on the upper surface of the perforated discharge nozzle member 11 and twisted either leftwardly or rightwardly. By doing so, the perforated discharge nozzle member 11 is rotated against the reinforcement of the leaf springs 11 until the side surface of each stopper projection 53 is brought into contact with the inside surface of the two-stage cut-out groove 64. As a consequence, the stopper projections 53 are moved above the lower stage portion 40 of the two-state cut-out groove 64. In that condition, when the perforated discharge nozzle member 11 is depressed by being stepped thereon, the stopper projection 53 is gradually inserted into the lower stage portion 40 and so, the perforated discharge nozzle member 11 is fully depressed, thus enabling to apply the application liquid directly to the sole side of the foot from a spray nozzle 19 via the nozzle ports 14.

When the application liquid has been applied, the foot placed on the perforated discharge nozzle member 11 is removed therefrom to release the depression. As a consequence, the perforated discharge nozzle member 11 is pushed up by the resiliency of a spring disposed within a valve for projecting the stem 13 and at the same time, the perforated discharge nozzle member 11 is rotated in a reversed direction by the reinforcement of the leaf springs 51 so as to be automatically restored to the original state in which the stopper projections 53 are located above the upper stage portion 39 of the two-stage cut-out groove 64 to restrict the depression of the perforated discharge nozzle member 11, just as the state before the foot is placed on the perforated discharge nozzle member 11. Accordingly, in order to discharge the application liquid from the spray nozzle 19, it is necessary to rotate the perforated discharge nozzle member 11 again.

That is, according to the aerosol container 10 of this embodiment, the perforated discharge nozzle member 11, when released, is automatically restored to a locked position in which the perforated discharge nozzle member 11 cannot be depressed. Thus, accidental discharge can easily be prevented from occurring.

According to the aerosol container 10 of this embodiment, when the perforated discharge nozzle member 11 of the aerosol container 10 placed under a desk or the like is depressed by being stepped thereon by the sole side of the foot, the application liquid is discharged towards the sole of the foot so that the discharged liquid can directly and rapidly be applied to the sole of the foot. Since the perforated discharge nozzle member 11 has an annular wall 32 disposed, as a projection, on the upper surface peripheral edge portion, the interval between the sole side of the foot and the nozzle ports 14 is retained when the perforated discharge nozzle member 11 is stepped thereon. Accordingly, the application liquid can smoothly be discharged. Also, since the perforated discharge nozzle member 11 is provided with a plurality of nozzle ports (seven in this embodiment) 14, the discharged application liquid can easily be applied over a wide area of the sole of the foot merely by a single stepping action.

It should be noted that the present invention is not limited to the above embodiment and various changes and modifications can be made. For example, the discharge nozzle member, which is not necessarily a perforated discharge nozzle member, may be a discharge nozzle member provided with a single nozzle port. The projection for retaining the interval between the sole of the foot and the nozzle ports is not necessarily an annular wall. Instead, it may be in the form of a plurality of rod-like projections (whose length dimension is, for example, 3 mm or more, and preferably 5 mm or more) each having a round tip portion, which are disposed in such a manner as to surround the nozzle ports. An angle of injection of each nozzle port may be set within a range of 45 degrees, for example, both leftwardly and rightwardly. The content liquid may include such chemicals as an insecticide, a sweat-restricting agent, an anti-bacterial agent, an antiphogistic agent and an ethanol, a perfume, and the like.

The means for placing the aerosol container on the floor in a stable manner so that it will not fall down when it is stepped on may include a method of designing the container body having a center of gravity and a bottom area such that the diameter of the bottom surface of the container body is, for example, 50 mm or more and ⅔ or more of the height, preferably 1.0 times or more of the height, and the a fall angle of the aerosol container becomes 30 degrees or more when the container body is emptied, a method of providing fixing means for fixedly placing the container body in a stepping position by means of a locking thread, an adhesive agent or an anti-slippage agent such as rubber disposed at the bottom potion of the container, or the like, a method of preliminarily disposing a fixing base for receiving the aerosol container in the stepping position and the aerosol container is changeably attached to this fixing base, and so forth.

Figure 6:
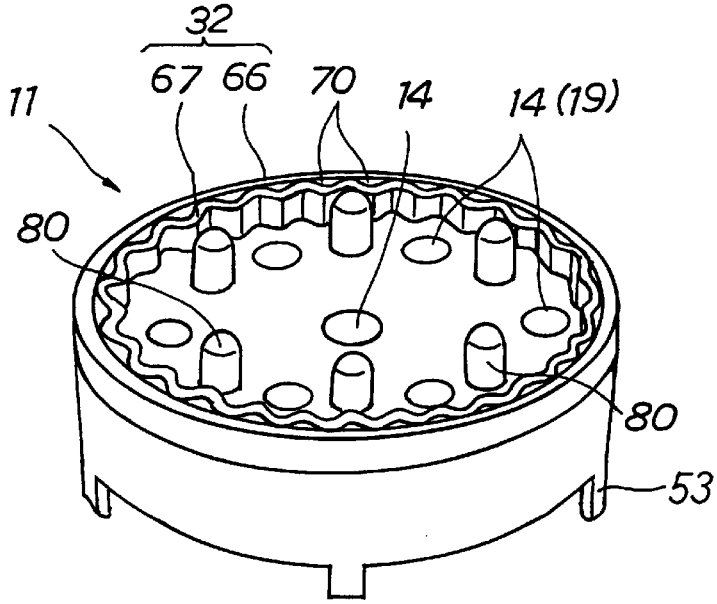
FIG. 6 is a perspective view for explaining another sound-reduction means disposed at the perforated discharge nozzle member.

Furthermore, according to the present invention, the annular wall 32 of the perforated discharge nozzle member 11, as shown in FIG. 6, may take the form of a duplex structure consisting of an outer circumferential wall 66 and an inner undulating wall 67, in which an outer bump of the inner undulating wall 67 is joined with an inner surface of the outer circumferential wall 66 and a gap 70 having a generally triangular configuration in section is formed every mountain part of the waveform between an outer valley of the inner undulating wall 67 and an inner surface of the outer circumferential wall 66. According to this type of an annular wall 32, by virtue of the arrangement including a duplex structure consisting of the outer circumferential wall 66 and the inner undulating wall 67 and the gap 70 formed therebetween, the silencing effect is enhanced. If the annular wall 32 is formed from foamed resin material, the silencing effect of the injection sound can further be enhanced. It is an interesting alternative that a foamed material such as a foamed polyethylene is bonded to the inner surface of the inner undulating wall 67 in order to enhance the silencing effect. The silencing effect can also be enhanced by applying, for example, a serrated configuration to the inner surface of the annular wall 32. The sound-reduction means is not necessarily structured by an annular wall.

If six projections 80 each having a height of about 5 mm are formed on the upper surface of the perforated discharge nozzle member 11 at a location between the adjacent nozzle ports 14 in the circumferential direction, they may press and stimulate effective spots in the sole side of the foot, thereby exhibiting a finger-pressure treatment effect, when the perforated discharge nozzle member 11 is depressed by the foot. In addition, this also serves to ensure a spraying distance for the application liquid.

The annular wall disposed along the upper surface peripheral edge portion of the discharge nozzle member may be an annular wall formed by providing a single or double of circumferential walls along the upper surface peripheral edge portion of the discharge nozzle member. The annular wall may also take the form of an annular wall in which the outer circumferential wall and the inner undulating wall are partly spacedly disposed without being bonded together at that area, or an annular wall in which the gap having a generally triangular configuration in section formed between the outer circumferential wall and the inner undulating wall is eliminated so that the both walls are integrally formed. It is also accepted that a ceiling member having a cut-out along the contour of the foot, for example, is joined with an upper end of the annular wall and such a cut-out is served as an opening having a size dimension able to be covered with the sole side of the foot. In addition, the inside of the annular wall 32 may be formed into a bowl configuration in such a manner that the upper end of the annular wall 32 connects to the upper surface of the perforated discharge nozzle member 11 through the inside wall of the annular wall 32 which gradually slopes to the inner side (see FIG. 7).

Figure 7:
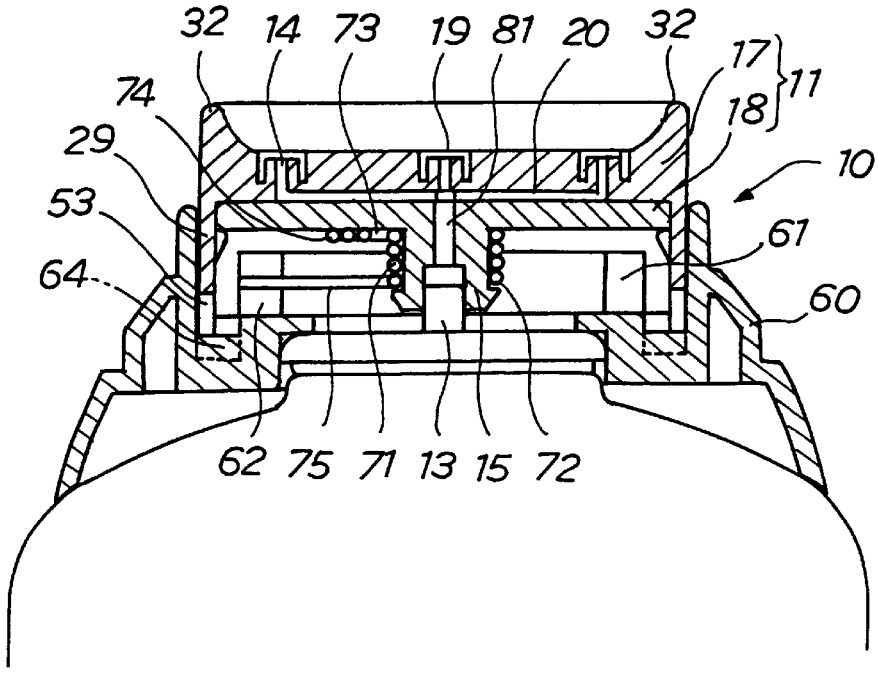
FIG. 7 is a sectional view for explaining rotational biasing means caused by a coiled spring.

As the rotation reinforcing means in which the stopper projections 53 of the perforated discharge nozzle member 11 are disposed at the upper-stage portion 39 of the two-stage cut-out groove 64, a coiled spring 71, as shown in FIG. 7, for example, may be employed instead of the leaf springs 51 of the above embodiment. That is, a coil part 72 of the coiled spring 71 is attached to the stem engagement projection 15 of the perforated discharge nozzle member 11, with one linear end portion 73 of the coiled spring 71 being held in a sandwiched manner between a pair of engagement projections 74 disposed on the lower surface of the nozzle member 11 and the other linear end portion 75 being held in the cut 62 formed in the circular wall 61 of the skirt member 60 in a sandwiched manner therebetween.

FIG. 7 shows another rotation reinforcing means capable of automatically restoring the perforated discharge nozzle member 11 to the original position before the foot is stepped on the perforated discharge nozzle member 11, by reversedly rotating the perforated discharge nozzle member 11, which has been rotated normally at the time for applying the application liquid, under the biasing effect of the coiled spring 71 so that the stopper projections 53 are located above the upper stage portion 39 of the two-stage cut-out groove 64 so as to restrict the depression of the perforated discharge nozzle member 11.

Although it is not absolutely necessary to incline the recess annular inclination surface 27 and the lower part annular inclination surface 28 for sandwiching the O-ring 26 therein at an angle of 45 degrees with respect to a reference plane such as the upper surface of the nozzle lower part, they are preferably inclined at an angle of 35 to 55 degrees and particularly preferably at an angle of 25 to 65 degrees. If the angle of inclination is within the range of 25 to 65 degrees, a reliable sealability can be obtained even for a perforated discharge nozzle member which does not have a strict accuracy of dimensions.

It is also accepted that the recess annular inclination surface is tapered towards inwardly and the lower part annular inclination surface is tapered outwardly. It is not absolutely necessary that those angles of inclination are coincident with each other so that the inclination surfaces are opposed with each other in parallel relation.

According to the aerosol container of the present invention, it is not absolutely necessary for the perforated discharge nozzle member to take the form of a disc-like configuration. Instead, it may take the form of a polygonal configuration such as a triangular configuration and a square configuration.

What is claimed is:

1. An aerosol container comprising:

a discharge nozzle member, disposed on a distal end of a body of said aerosol container with a content stored therein, for discharging the content onto a sole of a foot by stepping on said discharge nozzle member;

projections are provided at a location surrounding a plurality of nozzle ports formed in said discharge nozzle member and an interval between a side of the sole of the foot and said plurality of nozzle ports is retained by said projections when said discharge nozzle member is stepped on, wherein said discharge nozzle member is provided with sound-reduction means being an annular wall arranged as said projections surrounding said plurality of nozzle ports, and an upper end of said annular wall is defined as an opening having a size dimension able to be covered with the sole of the foot.

2. The aerosol container according to claim 1, wherein said discharge nozzle member is a perforated discharge nozzle member.

3. The aerosol container according to claim 1, further comprising:

a skirt member mounted on a peripheral surface of said body of said aerosol container;

a stem of said body of said aerosol container which is surrounded by said skirt member and to which said discharge nozzle member is attached such that, when said discharge nozzle member is rotated with respect to said skirt member, said discharge nozzle member is brought into a depressible position and when said depressible position is released, said discharge nozzle member is brought into an undepressible position.

4. The aerosol container according to claim 1, wherein said discharge nozzle member comprises a nozzle lower part fixedly engaged in an engagement recess, which is formed in a lower surface of a nozzle upper part, in a hermetically closed condition through an O-ring, and wherein a seal construction for hermetically closing said nozzle upper part and said nozzle lower part comprises a recess annular inclination surface formed by an outwardly or inwardly tapered abutment surface of said O-ring disposed in said engagement recess and a lower part annular inclination surface formed by an inwardly or outwardly tapered abutment surface of said O-ring and disposed in opposite relation to said recess annular inclination surface, said O-ring being inserted and sandwiched between said recess annular inclination surface and said lower part annular inclination surface in a compressed condition.

5. A method of using an aerosol container comprising the step of:

providing a discharge nozzle member on a distal end of a body of said aerosol container with a content stored therein;

forming a plurality of nozzle ports in said discharge nozzle member;

providing projections at a location surrounding said plurality of nozzle ports;

stepping on said discharge nozzle member to discharge the content of said aerosol container onto a sole of a foot so that the foot can be treated with the content;

retaining an interval between a side of the sole of the foot onto which the contents of said aerosol container are to be sprayed via said projections when said discharge nozzle member is stepped on; and providing said discharge nozzle member with sound-reduction means in the form of an annular wall arranged as said projections surrounding said plurality of nozzle ports, wherein an upper end of said annular wall is defined as an opening having a size dimension able to be covered with the sole of the foot.

* * * * *